US010006695B2

(12) United States Patent
Millar et al.

(10) Patent No.: US 10,006,695 B2
(45) Date of Patent: Jun. 26, 2018

(54) METHOD OF PRODUCING AND DISTRIBUTING LIQUID NATURAL GAS

(71) Applicants: 1304338 Alberta Ltd., Edmonton (CA); 1304342 Alberta Ltd., Edmonton (CA)

(72) Inventors: Mackenzie Millar, Edmonton (CA); Jose Lourenco, Edmonton (CA)

(73) Assignees: 1304338 Alberta Ltd., Edmonton (CA); 1304342 Alberta Ltd., Edmonton (CA)

( * ) Notice: Subject to any disclaimer, the term of this patent is extended or adjusted under 35 U.S.C. 154(b) by 332 days.

(21) Appl. No.: 14/424,845

(22) PCT Filed: Aug. 19, 2013

(86) PCT No.: PCT/CA2013/050639
§ 371 (c)(1),
(2) Date: Feb. 27, 2015

(87) PCT Pub. No.: WO2014/032179
PCT Pub. Date: Mar. 6, 2014

(65) Prior Publication Data

US 2015/0219392 A1 Aug. 6, 2015

(30) Foreign Application Priority Data

Aug. 27, 2012 (CA) ..... 2787746

(51) Int. Cl.
*F25J 1/02* (2006.01)
*F25J 1/00* (2006.01)
(Continued)

(52) U.S. Cl.
CPC ..... *F25J 1/0022* (2013.01); *C10L 3/12* (2013.01); *F25J 1/004* (2013.01); *F25J 1/0037* (2013.01);
(Continued)

(58) Field of Classification Search
CPC ..... F25J 1/0022; F25J 1/023; F25J 1/0231; F25J 1/0037; F25J 1/0201; F25J 1/0274;
(Continued)

(56) References Cited

U.S. PATENT DOCUMENTS 2,168,428 A 8/1939 Mellor
3,002,362 A 10/1961 Morrison
(Continued)

FOREIGN PATENT DOCUMENTS

CA 1 048 876 A 2/1979
CA 2 299 695 A1 3/1999
(Continued)

OTHER PUBLICATIONS

Hudson, H.M., et al., "Reducing Treating Requirements for Cryogenic NGL Recovery Plants," Presented at the 80th Annual Convention of the Gas Processors Association, Mar. 12, 2001, San Antonio, Texas, 15 pages.
(Continued)

*Primary Examiner* — Frantz Jules
*Assistant Examiner* — Brian King
(74) *Attorney, Agent, or Firm* — Christensen O'Connor Johnson Kindness PLLC

(57) ABSTRACT

A method for producing liquid natural gas (LNG) includes the following steps. Compressor stations forming part of existing natural-gas distribution network are identified. Compressor stations that are geographically suited for localized distribution of LNG are selected. Natural gas flowing through the selected compressor stations is diverted to provide a high pressure first natural gas stream and a high pressure second natural gas stream. A pressure of the first natural gas stream is lowered to produce cold temperatures through pressure let-down gas expansion and then the first natural gas stream is consumed as a fuel gas for an engine
(Continued)

driving a compressor at the compressor station. The second natural gas stream is first cooled with the cold temperatures generated by the first natural gas stream, and then expanded to a lower pressure, thus producing LNG.

10 Claims, 5 Drawing Sheets

(51) Int. Cl.
*C10L 3/12* (2006.01)
*F25J 3/06* (2006.01)
*C10L 3/10* (2006.01)

(52) U.S. Cl.
CPC ..... *F25J 1/0201* (2013.01); *F25J 1/0202* (2013.01); *F25J 1/023* (2013.01); *F25J 1/0232* (2013.01); *F25J 1/0274* (2013.01); *F25J 3/0615* (2013.01); *C10L 3/101* (2013.01); *C10L 3/106* (2013.01); *F25J 2210/06* (2013.01); *F25J 2220/64* (2013.01); *F25J 2230/22* (2013.01); *F25J 2230/30* (2013.01); *F25J 2240/40* (2013.01); *F25J 2240/70* (2013.01); *F25J 2240/82* (2013.01)

(58) Field of Classification Search
CPC ... F25J 2210/06; F25J 2240/82; F25J 2240/80
See application file for complete search history.

(56) References Cited

U.S. PATENT DOCUMENTS

| | | | | |
|---|---|---|---|---|
| 3,152,194 | A | 10/1964 | Pohl | |
| 3,184,926 | A | 5/1965 | Blake | |
| 3,367,122 | A | 2/1968 | Tutton | |
| 3,653,220 | A * | 4/1972 | Foster | F25J 3/061 62/639 |
| 3,735,600 | A | 5/1973 | Dowdell et al. | |
| 3,754,405 | A | 8/1973 | Rosen | |
| 3,792,590 | A | 2/1974 | Lofredo | |
| 3,846,993 | A | 11/1974 | Bates | |
| 3,859,811 | A | 1/1975 | Duncan | |
| 4,279,130 | A | 7/1981 | Finch | |
| 4,418,530 | A | 12/1983 | Bodrov | |
| 4,424,680 | A | 1/1984 | Rothchild | |
| 4,430,103 | A | 2/1984 | Gray | |
| 4,444,577 | A | 4/1984 | Perez | |
| 4,617,039 | A | 10/1986 | Buck | |
| 4,710,214 | A | 12/1987 | Sharma | |
| 4,751,151 | A | 6/1988 | Healy | |
| 5,137,558 | A | 8/1992 | Agrawal | |
| 5,295,350 | A | 3/1994 | Child | |
| 5,329,774 | A | 7/1994 | Tanguay | |
| 5,425,230 | A | 6/1995 | Shpak | |
| 5,440,894 | A | 8/1995 | Schaeffer | |
| 5,678,411 | A | 10/1997 | Matsumura | |
| 5,685,170 | A | 11/1997 | Sorensen | |
| 5,799,505 | A | 9/1998 | Bonaquist | |
| 6,089,022 | A | 7/2000 | Zednik | |
| 6,131,407 | A | 10/2000 | Wissolik | |
| 6,138,473 | A | 10/2000 | Boyer-Vidal | |
| 6,182,469 | B1 | 2/2001 | Campbell | |
| 6,266,968 | B1 | 7/2001 | Redlich | |
| 6,286,315 | B1 | 9/2001 | Staehle | |
| 6,378,330 | B1 | 4/2002 | Minta | |
| 6,432,565 | B1 | 8/2002 | Haines | |
| 6,517,286 | B1 | 2/2003 | Latchem | |
| 6,526,777 | B1 | 3/2003 | Campbell | |
| 6,581,409 | B2 | 6/2003 | Wilding | |
| 6,606,860 | B2 | 8/2003 | McFarland | |
| 6,640,555 | B2 | 11/2003 | Cashin | |
| 6,662,589 | B1 | 12/2003 | Roberts | |
| 6,694,774 | B1 * | 2/2004 | Rashad | F25J 1/0005 62/611 |
| 6,739,140 | B2 | 5/2004 | Bishop | |
| 6,751,985 | B2 | 6/2004 | Kimble | |
| 6,932,121 | B1 | 8/2005 | Shivers, III | |
| 6,945,049 | B2 | 9/2005 | Madsen | |
| 7,107,788 | B2 | 9/2006 | Patel | |
| 7,155,917 | B2 | 1/2007 | Baudat | |
| 7,219,502 | B2 | 5/2007 | Nierenberg | |
| 7,257,966 | B2 | 8/2007 | Lee | |
| 7,377,127 | B2 | 5/2008 | Mak | |
| 2002/0170297 | A1 | 11/2002 | Quine | |
| 2003/0008605 | A1 | 1/2003 | Hartford, Jr. | |
| 2003/0019219 | A1 | 1/2003 | Viegas | |
| 2003/0051875 | A1 | 3/2003 | Wilson | |
| 2003/0196452 | A1 | 10/2003 | Wilding | |
| 2004/0065085 | A1 | 4/2004 | Madsen | |
| 2005/0086974 | A1 | 4/2005 | Steinbach | |
| 2005/0244277 | A1 | 11/2005 | Hurst, Jr. | |
| 2006/0213222 | A1 * | 9/2006 | Whitesell | F25J 1/0202 62/612 |
| 2006/0213223 | A1 | 9/2006 | Wilding | |
| 2006/0242970 | A1 | 11/2006 | Yang | |
| 2007/0107465 | A1 | 5/2007 | Turner | |
| 2008/0016910 | A1 | 1/2008 | Brostow | |
| 2009/0113928 | A1 * | 5/2009 | Vandor | F25J 1/0022 62/612 |
| 2009/0249829 | A1 | 10/2009 | Lourenco | |
| 2009/0282865 | A1 | 11/2009 | Martinez | |

FOREIGN PATENT DOCUMENTS

| | | | |
|---|---|---|---|
| CA | 2 318 802 | A1 | 8/1999 |
| CA | 2 422 893 | A1 | 8/2001 |
| CA | 2 467 338 | A1 | 7/2003 |
| CA | 2 515 999 | A1 | 9/2004 |
| CA | 2 552 366 | A1 | 7/2005 |
| CN | 1615415 | A | 5/2005 |
| CN | 101948706 | A | 1/2011 |
| DE | 44 16 359 | A1 | 11/1995 |
| EP | 0 482 222 | A1 | 4/1992 |
| EP | 0 566 285 | A1 | 10/1993 |
| EP | 0 635 673 | A1 | 1/1995 |
| EP | 0 780 649 | A1 | 6/1997 |
| FR | 2 420 081 | A1 | 10/1979 |
| GB | 2 103 354 | A | 2/1983 |
| JP | 3-236589 | A | 10/1991 |
| JP | 5-263998 | A | 10/1993 |
| JP | 2002-295799 | A | 10/2002 |
| RU | 2 180 420 | C2 | 3/2002 |
| RU | 2 232 242 | C1 | 7/2004 |
| WO | 94/11626 | A1 | 5/1994 |
| WO | 97/01069 | A1 | 1/1997 |
| WO | 98/59205 | A2 | 12/1998 |
| WO | 00/52403 | A1 | 9/2000 |
| WO | 03/081038 | A1 | 10/2003 |
| WO | 03/095913 | A1 | 11/2003 |
| WO | 03/095914 | A1 | 11/2003 |
| WO | 2004/010480 | A1 | 1/2004 |
| WO | 2004/109180 | A1 | 12/2004 |
| WO | 2004/109206 | A1 | 12/2004 |
| WO | 2005/045337 | A1 | 5/2005 |
| WO | 2006/004723 | A1 | 1/2006 |
| WO | 2006/019900 | A1 | 2/2006 |
| WO | 2006/036441 | A1 | 4/2006 |
| WO | 2009/061777 | A1 | 5/2009 |

OTHER PUBLICATIONS

International Search Report dated Oct. 24, 2013, issued in corresponding International Application No. PCT/CA2013/050639, filed Aug. 19, 2013, 4 pages.

English Translation of Chinese Office Action issued in corresponding Chinese Application No. 201380055421.8, filed Aug. 19, 2013, 2 pages.

* cited by examiner

METHOD OF PRODUCING AND DISTRIBUTING LIQUID NATURAL GAS

FIELD

There is described a method of producing and distributing liquid natural gas (LNG) for use as a transportation fuel.

BACKGROUND

North American natural gas supplies are presently abundant due to new developments in natural gas exploration and production that have allowed previously inaccessible reserves to be cost-effectively exploited. This has resulted in a natural gas surplus, with forecasts indicating that supplies will remain high, and prices low, well into the future. The natural gas industry has identified the processing of natural gas into LNG, for use primarily as a fuel source for the transportation industry, as a way to add value to surplus natural gas supplies. Currently, LNG is produced in large plants requiring significant capital investments and high energy inputs. The cost of transportation of LNG from these large plants to local LNG markets for use as a transportation fuel is approximately $1.00 per gallon of LNG. The challenge for the natural gas industry is to find a cost-effective production and distribution method that will make LNG a viable alternative to more commonly used transportation fuels.

SUMMARY

The North American gas pipeline network is a highly integrated transmission grid that delivers natural gas from production areas to many locations in Canada and the USA. This network relies on compression stations to maintain a continuous flow of natural gas between supply areas and markets. Compressor stations are usually situated at intervals of between 75 and 150 km along the length of the pipeline system. Most compressor stations are fuelled by a portion of the natural gas flowing through the station. The average station is capable of moving about 700 million cubic feet of natural gas per day (MMSCFD) and may consume over 1 MMSCFD to power the compressors, while the largest can move as much as 4.6 billion cubic feet per day and may consume over 7 MMSCFD.

The technology described in this document involves converting a stream of natural gas that passes through the compressor stations into LNG. The process takes advantage of the pressure differential between the high-pressure line and the low-pressure fuel-gas streams consumed in mechanical-drive engines to produce cold temperatures through pressure let-down gas expansion. By utilizing the existing network of compressor stations throughout North America, this technology provides a low-cost method of producing and distributing LNG for use as a transportation fuel and for use in other fuel applications as a replacement fuel.

In broad terms, the method for producing liquid natural gas (LNG) includes the following steps. A first step is involved of identifying compressor stations forming part of existing natural-gas distribution network. A second step is involved in selecting compressor stations that are geographically suited for localized distribution of LNG. A third step is involved of diverting from natural gas flowing through the selected compressor stations a high pressure first natural gas stream and a high pressure second natural gas stream. A fourth step is involved of lowering a pressure of the first natural gas stream to produce cold temperatures through pressure let-down gas expansion and using the first natural gas stream as fuel gas for an internal combustion or turbine engine for a mechanical drive driving a compressor at the compressor station. A fifth step is involved of cooling the second natural gas stream with the cold temperatures generated by the first natural gas stream, and then expanding the second natural gas stream to a lower pressure, thus producing LNG.

BRIEF DESCRIPTION OF THE DRAWINGS

These and other features will become more apparent from the following description in which reference is made to the appended drawings. The drawings are for the purpose of illustration only and are not intended to be in any way limiting, wherein.

DETAILED DESCRIPTION

The following description of a method for producing and distributing LNG will refer to FIGS. 1 through 5. This method was developed to produce LNG at compressor stations along natural-gas transmission pipelines. It enables LNG to be produced economically at geographically distributed locations.

As explained above, the method was developed to produce LNG at natural-gas compression stations located on the natural-gas transmission pipeline network. The process takes advantage of the pressure differential between the high-pressure line and the low-pressure fuel-gas streams consumed in mechanical-drive engines at transmission-pipeline compressor stations. The invention allows for the small-to-medium scale production of LNG at any gas compression station along the pipeline system. The ability to produce LNG in proximity to market provides a significant cost advantage over the existing method for generating LNG, which typically involves large, centrally located production and storage facilities requiring logistical systems for plant-to-market transportation.

Figure 1:
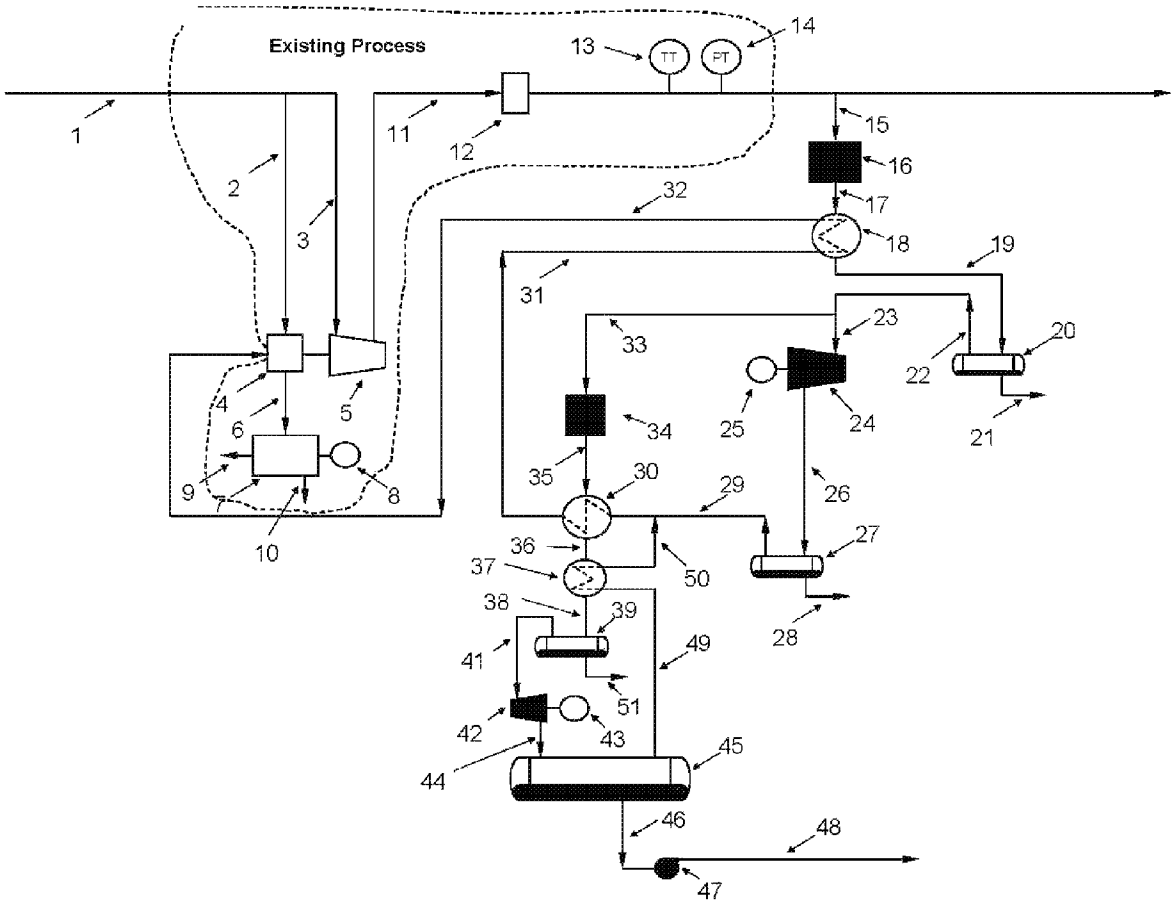
FIG. 1 is a schematic diagram of an LNG production plant at a natural-gas transmission-pipeline compression station equipped with gas pre-treatment units, heat exchangers, turbo expanders, KO drums, pumps and LNG storage. The process natural-gas stream is supplied from the high-pressure natural-gas transmission-pipeline stream.

Referring to FIG. 1, in a typical natural-gas compressor station in a natural-gas transmission pipeline, the lower pressure stream 1 is split into streams 2 and 3. Stream 2 is the fuel-gas stream to mechanical drive 4, an internal combustion engine or turbine engine that provides the shaft power to drive compressor 5. The products of combustion 6 (hot flue gases) flow into heat recovery unit 7, where its thermal energy is recovered either in the form of steam or a circulating heating oil that can be used in the generation of electricity 8 and or heat distribution 9. The cooler flue gas stream 10 is vented to the atmosphere. The transmission-pipeline stream 11 pressure is controlled on demand by pressure transmitter 14 to mechanical drive 4. The pressure transmitter 12 demand regulates the gas fuel supply stream 2 to the combustion engine or turbine engine of mechanical drive 4, which subsequently drives compressor 5 for pressure delivery. The transmission pipeline natural-gas stream 11 temperature is controlled by temperature transmitter 13, which controls an air-cooled heat exchanger 12 to a desired operations temperature. The desired operations temperature is dependent on the geographic location of the compression station. The above describes a typical existing process at natural-gas transmission-pipeline compression stations. In certain compression stations, the recovery of the thermal energy in stream 6 is not employed.

Referring to the invention, a natural-gas stream 15, downstream of air-cooled heat exchanger 12, is first pre-treated to remove water at gas pre-treatment unit 16. The pre-treated natural-gas stream 17 is cooled in a heat exchanger 18. The cooled natural-gas stream 19 enters knock-out drum 20 to separate condensates. The condensates are removed through line 21. The natural-gas vapour fraction exits the knock-out drum through stream 22 and is separated into two streams: the LNG-product stream 33 and the fuel-gas stream 23. The high-pressure natural-gas stream 23 enters turbo expander 24, where the pressure is reduced to the mechanical-drive combustion engine 4 operating pressure, producing shaft power that turns generator 25, producing electricity. The work produced by the pressure drop of stream 23 results in a substantial temperature drop of stream 26. This stream enters knock-out drum 27 to separate the liquids from the vapour fraction. The liquid fraction is removed through line 28. The separated fuel-gas vapour stream 29 is warmed up in a heat exchanger 30; the heated fuel-gas stream is further heated in a heat exchanger 18. The warm natural-gas feed stream 32 is routed to mechanical-drive engine 4, displacing the fuel gas supplied by fuel-gas stream 2. The high-pressure LNG product stream 33 is further treated for carbon dioxide removal in pre-treatment unit 34. The treated LNG product stream 35 is cooled in a heat exchanger 30. The cooler LNG product stream 36 is further cooled in a heat exchanger 37; the colder stream 38 enters knock-out drum 39 to separate the natural gas liquids (NGLs). The NGLs are removed through line 51. The high-pressure LNG product vapour stream 41 enters turbo expander 42, where the pressure is reduced, producing shaft power that turns generator 43, producing electricity. The work produced by the pressure drop of stream 41 results in a substantial temperature drop of stream 44, producing LNG that is accumulated in LNG receiver 45. The produced LNG stream 46 is pumped through LNG pump 47 to storage through stream 48. The vapour fraction in LNG receiver 45 exits through line 49, where it gives up its cryogenic cold in a heat exchanger 37. The warmer methane vapour stream 50 enters fuel gas stream 29, to be consumed as fuel gas. The inventive step is the use of the available pressure differential at these compressor stations, allowing for the significantly more cost-effective production of LNG. This feature, coupled with the availability of compressor stations at intervals of between 75 and 150 km along the natural-gas pipeline network, enables the economical distribution of LNG. Another feature of the process is the added capability of producing NGLs, as shown in streams 21, 28 and 51. These NGLs can be marketed separately or simply returned to the gas transmission pipeline stream 11.

Figure 2:
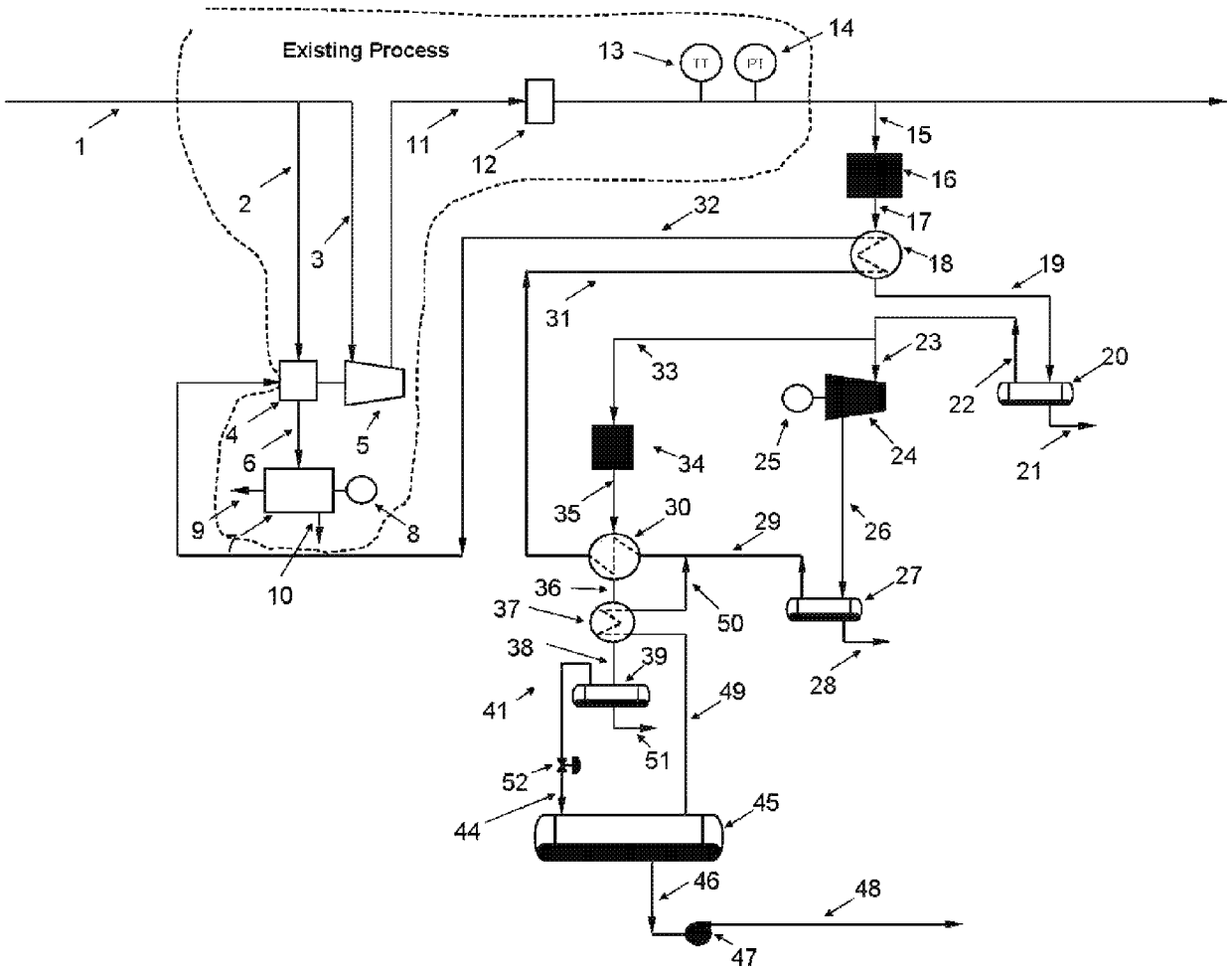
FIG. 2 is a schematic diagram of an LNG production plant at a natural-gas transmission-pipeline compression station with a variation in the process whereby the turbo expander in the LNG production stream is replaced by a Joule Thompson valve.

Referring to FIG. 2, the main difference from FIG. 1 is the removal and replacement of the turbo expander in LNG production stream 41 by JT valve 52. The reason for the modification is to take advantage of the lower capital cost of a JT valve versus a turbo expander. This variation will produce less LNG than the preferred FIG. 1.

Figure 3:
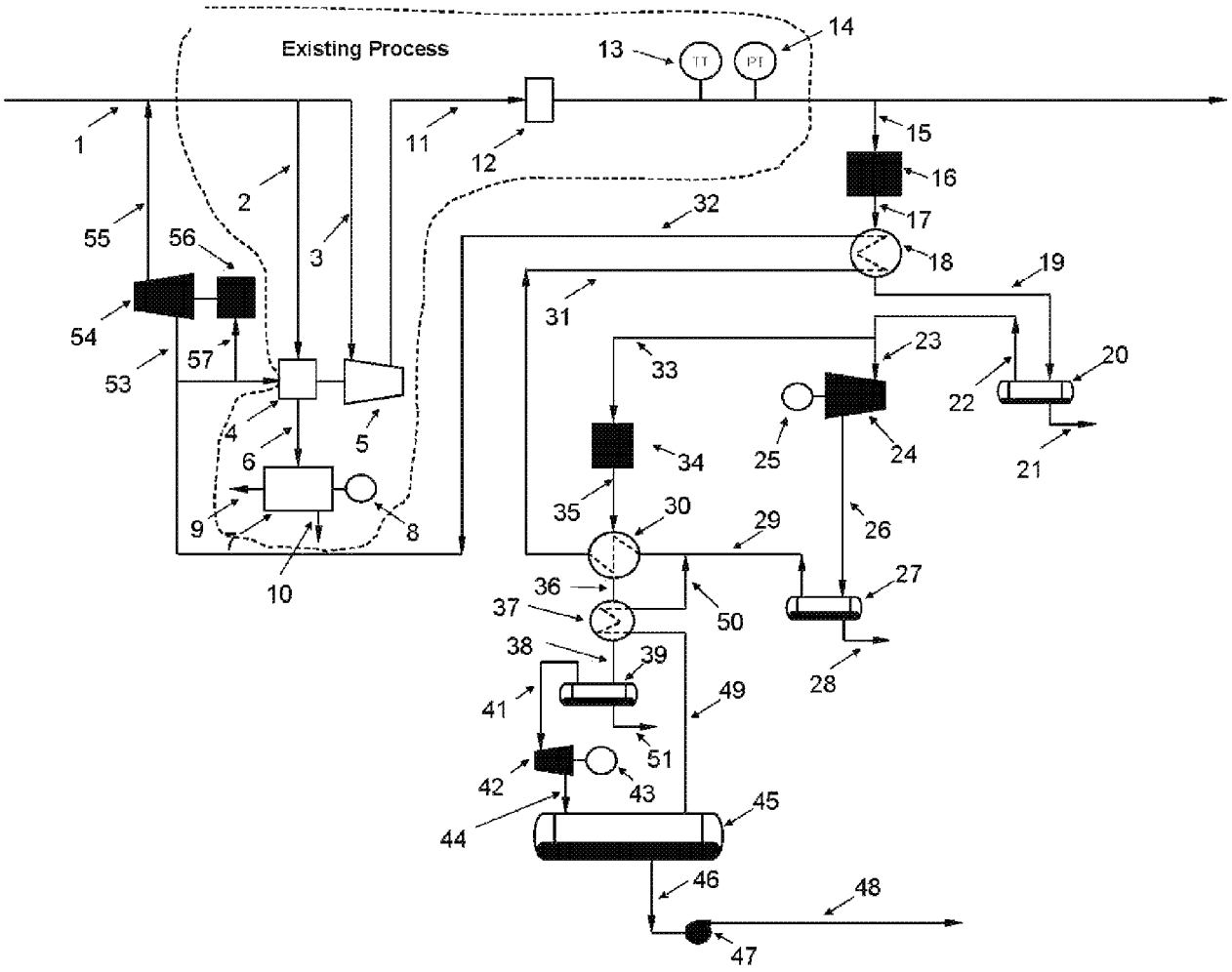
FIG. 3 is a schematic diagram of an LNG production plant at a natural-gas transmission-pipeline compression station with a variation in the process whereby the production of LNG is not limited by the volume of fuel gas consumed in the mechanical drive.

Referring to FIG. 3, the main difference from FIG. 1 is the addition of a natural-gas line stream 53, which is compressed by compressor 54 and discharged through stream 55 back to natural-gas transmission pipeline 1. The compressor 54 mechanical-drive engine 56 is fuelled either by a fuel-gas stream 57 or power available at the site. The objective is to allow LNG production at a compressor station without being limited by the volume of fuel gas consumption at the compressor mechanical-drive engine. This variation addresses the limitation, as shown in FIGS. 1, 2, 4 and 5, by adding a compression loop back to natural-gas stream 1. Stream 32 could supply other low-pressure, natural-gas users, if demand is present.

Figure 4:
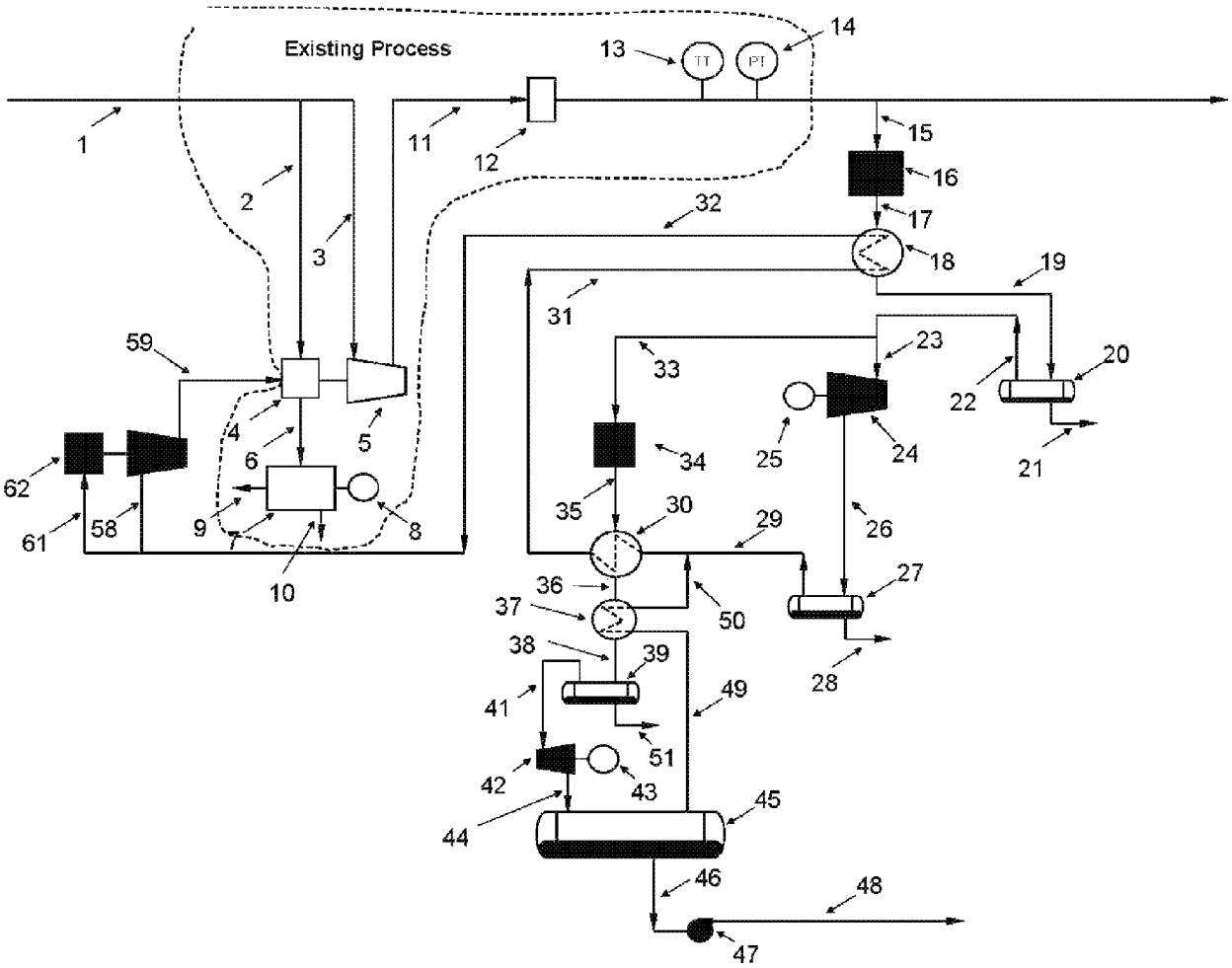
FIG. 4 is a schematic diagram of an LNG production plant at a natural-gas transmission-pipeline compression station with a variation in the process whereby the fuel gas to the mechanical drive engine is re-compressed to meet engine pressure requirements.

Referring to FIG. 4, the main difference from FIG. 1 is the re-compression of the fuel-gas stream 32 to the mechanical-drive engines 4. This is done by the addition of a natural-gas stream 58, which is compressed by compressor 62 and discharged through stream 59 to mechanical drive engine 4 operating pressure. The compressor mechanical-drive engine 62 is fuelled either by fuel-gas stream 61 or power available at the site. This may be needed in applications where turbines are employed and a higher fuel-gas pressure might be required.

Figure 5:
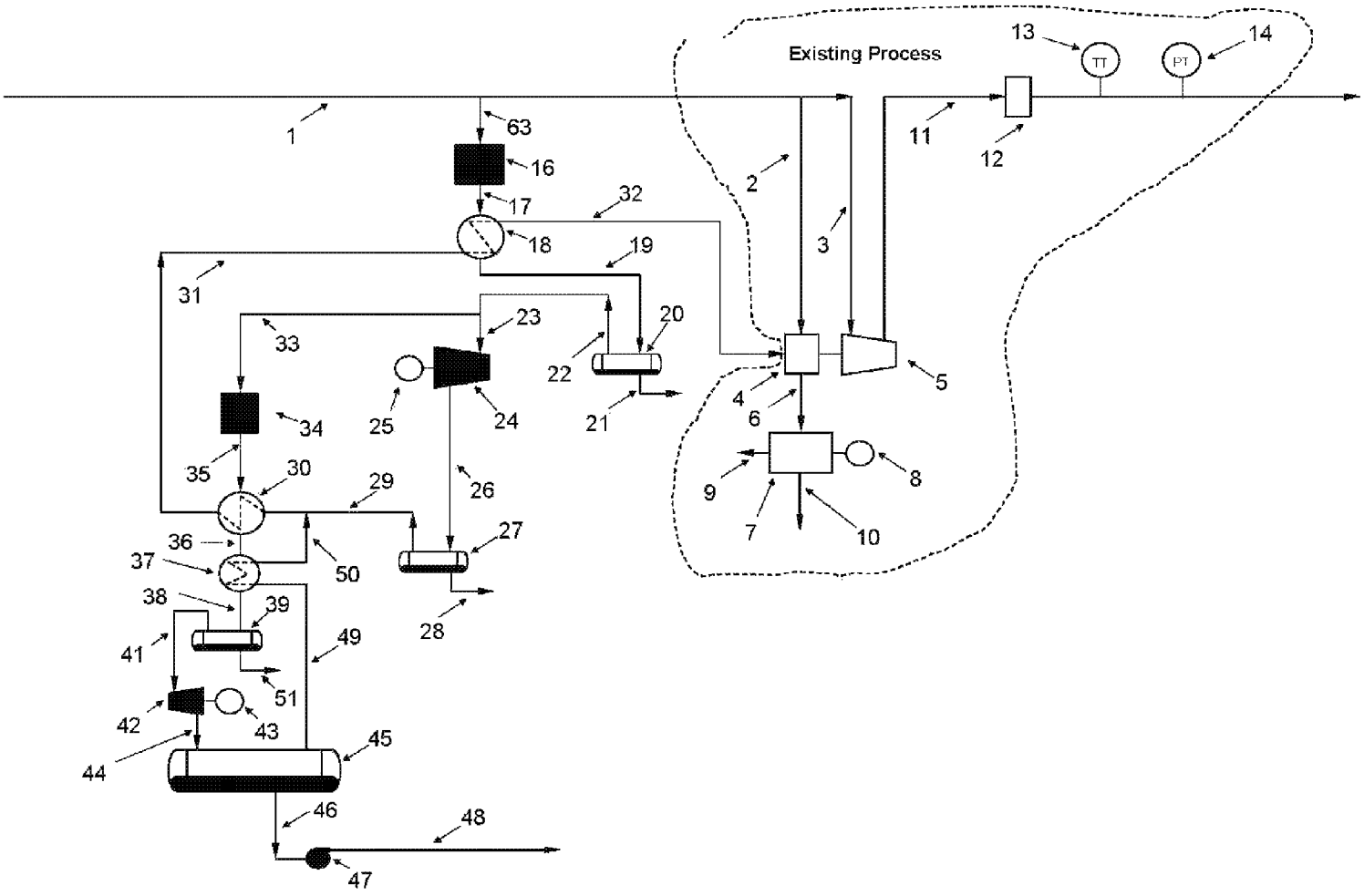
FIG. 5 is a schematic diagram of an LNG production plant at a natural-gas transmission-pipeline compression station with a variation in the process whereby the LNG production stream line is supplied from the natural-gas pipeline pressure upstream of the compressor.

Referring to FIG. 5, the main difference from FIG. 1 is the natural-gas feed stream 63. Whereas in FIG. 1, stream 15 is a high-pressure stream from natural-gas transmission pipeline 11, in FIG. 4 the natural-gas feed stream 63 is from natural-gas transmission pipeline 1, which operates at a lower pressure. In this case, the production of LNG would be less than that using the preferred process shown in FIG. 1.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the preferred embodiments set forth in the examples, but should be given a broad purposive interpretation consistent with the description as a whole.

What is claimed is:

1. A method for producing liquid natural gas (LNG), comprising:

identifying compressor stations forming part of an existing natural gas distribution network, the compressor stations compressing a stream of natural gas flowing through a pipeline;

selecting compressor stations that are geographically suited for localized distribution of LNG;

at selected compressor stations, diverting a high pressure first natural gas stream and a high pressure second natural gas stream from the stream of natural gas flowing through the pipeline;

lowering a pressure of the first natural gas stream to produce cold temperatures through pressure let-down gas expansion and using the first natural gas stream as fuel gas for an internal combustion or turbine engine for a mechanical drive driving a compressor at the compressor station to compress the stream of natural gas flowing through the pipeline; and cooling the second natural gas stream with the cold temperatures generated through pressure let-down of the first natural gas stream, and then expanding the second natural gas stream to a lower pressure and using the cold temperatures generated through pressure let-down of the second natural gas stream to produce LNG.

2. The method of claim 1, wherein a step is taken of pre-treating the first natural gas stream and the second natural gas stream by removing water before lowering the pressure.

3. The method of claim 2, wherein a step is taken of cooling second natural gas stream that has the water removed and removing hydrocarbon condensates before lowering the pressure.

4. The method of claim 2, wherein a step is taken of removing carbon dioxide from second natural gas stream that has the water removed before lowering the pressure.

5. The method of claim 1, wherein the step of cooling of the second natural gas stream is accomplished by a heat exchange through one or more heat exchangers.

6. The method of claim 3, wherein the step of cooling of the second natural gas stream is affected through a heat exchange with a vapour fraction from the first natural gas stream.

7. The method of claim 1, wherein the high-pressure first natural gas stream and the high pressure second natural gas stream are taken from either a discharge side or a suction side of a compressor.

8. The method of claim 1, wherein the lowering of the pressure of the high pressure first natural gas stream is accomplished by passing the first natural gas stream through a turbo expander.

9. The method of claim 2, wherein the lowering of the pressure of the high pressure second natural gas stream is accomplished by passing the second natural gas stream through one of a turbo expander or a JT valve.

10. The method of claim 3, wherein hydrocarbon condensates removed are captured in knock-out drums.

* * * * *